US006378626B1

(12) United States Patent
Wallace

(10) Patent No.: US 6,378,626 B1
(45) Date of Patent: Apr. 30, 2002

(54) BALANCED TORQUE DRILLING SYSTEM

(76) Inventor: Donald W. Wallace, P.O. Box 76, Smithville, TX (US) 78957

( * ) Notice: Subject to any disclaimer, the term of this patent is extended or adjusted under 35 U.S.C. 154(b) by 0 days.

(21) Appl. No.: 09/606,607

(22) Filed: Jun. 29, 2000

(51) Int. Cl.[7] ..... E21B 7/26

(52) U.S. Cl. ..... 175/19; 175/107; 175/269; 175/279

(58) Field of Search ..... 175/95, 96, 98–101, 175/106, 107, 265, 269, 273, 279, 19

(56) References Cited

U.S. PATENT DOCUMENTS

| | | | | | |
|---|---|---|---|---|---|
| 4,059,165 | A | * | 11/1977 | Clark | 175/107 |
| 4,270,619 | A | | 6/1981 | Base | 175/61 |
| 4,368,786 | A | | 1/1983 | Cousins | 175/78 |
| 4,385,669 | A | | 5/1983 | Knutsen | 175/323 |
| 4,456,080 | A | | 6/1984 | Holbert | 175/61 |
| 4,523,652 | A | | 6/1985 | Schuh | 175/61 |
| 4,577,701 | A | | 3/1986 | Dellinger et al. | 175/61 |
| 4,690,229 | A | | 9/1987 | Raney | 175/325 |
| 4,775,017 | A | | 10/1988 | Forrest et al. | 175/65 |
| 4,852,669 | A | | 8/1989 | Walker | 175/73 |
| 4,862,974 | A | | 9/1989 | Warren et al. | 175/61 |
| 4,899,833 | A | | 2/1990 | Warren et al. | 175/45 |
| 5,033,558 | A | | 7/1991 | Russo et al. | 175/325 |
| 5,402,856 | A | * | 4/1995 | Warren et al. | 175/57 |
| 5,458,208 | A | | 10/1995 | Clarke | 175/45 |
| 5,513,528 | A | | 5/1996 | Holenka et al. | 73/151 |
| 6,009,961 | A | * | 1/2000 | Pietrobelli et al. | 175/269 |

* cited by examiner

*Primary Examiner*—David Bagnell
*Assistant Examiner*—Zakiya Walker
(74) *Attorney, Agent, or Firm*—Browning Bushman P.C.

(57) ABSTRACT

The invention combines a mud motor, a drill bit, a transmission, an underreamer and a torque tube to simultaneously drill a well by rotating the drill bit in one direction and the underreamer in the opposite direction to balance the torque supplied to the bit and the underreamer.

9 Claims, 4 Drawing Sheets

24
25
23
78
51
52
80
4
4
82
22a
60
61
63
62
63
5
5
65
64
22
3
3
20
26a
26c
26b
12
18

26
18
12
18
16
84
86
14
19
10

BALANCED TORQUE DRILLING SYSTEM

FIELD OF THE INVENTION

This invention relates to an improved method of and apparatus for drilling oil and gas wells using a mud motor.

BACKGROUND OF THE INVENTION

When drilling with a mud motor reactive torque is a problem. High drilling rates and high weight on the bit causes the mud motor to stall, the bit to stop, and the drill string to rotate in the opposite direction due to torque build up in the drill string, and mud motor failure all caused by reactive torque, and torsional loads on the drill string. Therefore, it is an object of this invention to provide apparatus for and method of drilling that will balance reactive torque by drilling and underreaming simultaneously with a bit rotating in one direction and an underreamer rotating in an opposite direction.

SUMMARY OF THE INVENTION

Specifically, the apparatus of this invention includes a drill bit, a fluid powered motor connected to the bit for rotating the bit, an underreamer above the bit to increase the diameter of the well bore, and a gear box positioned between the bit and the underreamer for transmitting the reactive torque of the fluid powered motor to the underreamer to rotate the underreamer in a direction opposite that of the bit so that the torque rotating the bit is substantially the same as the torque rotating the underreamer to therefore create a balanced torque drilling system.

A hollow mandrel or torque tube 22 extends along the central axis of the apparatus from just above fluid powered motor 18 to just below top connection 25. Spline connection 23 between the upper end of the torque tube and bottom end 51 of connector 25 hold the torque tube from rotating around the central axis of the tool. The lower end of the torque tube is prevented from rotating by pins 36*a* and 36*c* that extend through pinions 28*a* and 28*c*, respectively, and the wall of housing 12. The torque tube, be it titanium and/or composite, serves to absorb shock torque especially from formation breaks, but also to permit rotating the drill string with the rotary table while drilling with a mud motor. This allows the tool to build angle with stabilizers when desired.

Therefore, it is an object and feature of this invention to provide a down hole drilling assembly to minimize or balance the reactive torque of a mud motor rotating a bit in one direction with an underreamer rotating in the opposite direction. This is accomplished by a gear box located between the mud motor and the underreamer. Specifically, the bit is turned by a mud motor, the upper end of the motor drives a reversing gear box that turns the underreamer in a direction opposite that of the bit. A torque tube or mandrel extends along the longitudinal central axis of the tool. The lower end of the torque tube is connected to the gearbox and to the gear box housing to hold lower housing section 12 in position to enclose and support the gear box and the mud motor. The torque tube also serves to supply drilling fluid under pressure to the mud motor through openings 26*a*, 26*b* and 26*c* in spacer 20 to rotate the bit connected to the output shaft of the mud motor. The torque tube is an axis guide for the underreamer to rotate about. Balancing the rotating members such as bit, stabilizer and underreamer is accomplished by grooved circular races 82 and 86 that contain a portion of high density small pellets in an oil/TEFLON fluid median. The pellets do not fill the grooves so that centrifugal force produced by the rotating tool causes balancing and increases mud motor life by decreasing bearing failure. FIG. 4 is an enlarged cross section view of one of the balancing grooves.

These and other objects, advantages, and features of this invention will be apparent to those skilled in the art from this specification including the attached drawings, and appended claims.

BRIEF DESCRIPTION OF THE DRAWINGS

The preferred embodiment of the invention will be described in detail below with reference to the following drawings.

DESCRIPTION OF THE PREFERRED EMBODIMENTS

Figure 1:
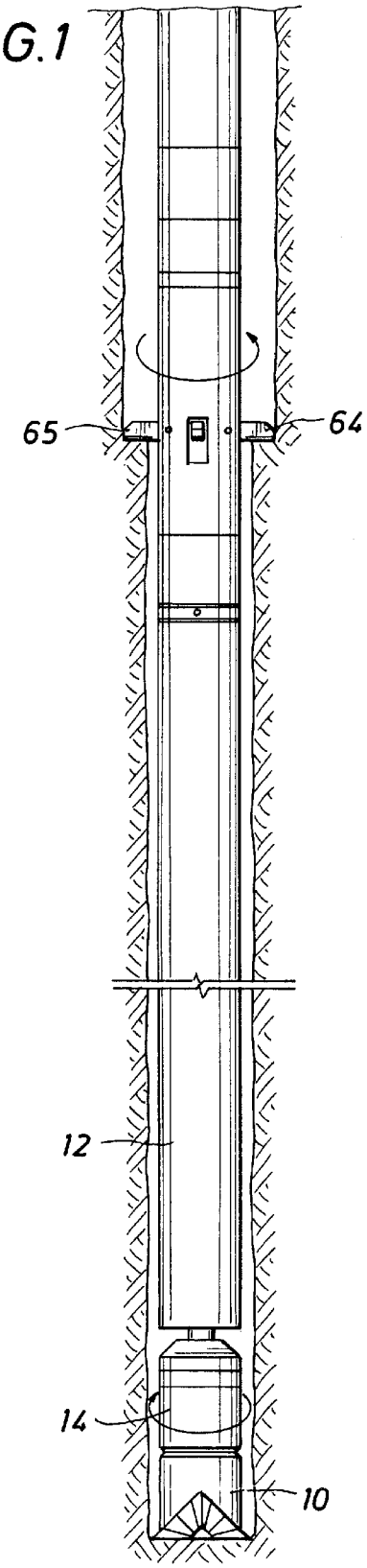
FIG. 1 is a view, in elevation of the drilling assembly of this invention in the process of drilling a well bore with a conventional bit and simultaneously underreaming the well bore drilled by the bit to a larger diameter by an underreamer spaced above the bit.

In FIG. 1 the drilling assembly of this invention is shown in elevation. At the lower end, drill bit 10 is in contact with the bottom of well bore 19 and is being rotated to the right relative to housing 12 by the apparatus in housings 12 and 14 that will be described in detail below.

Figure 2A:
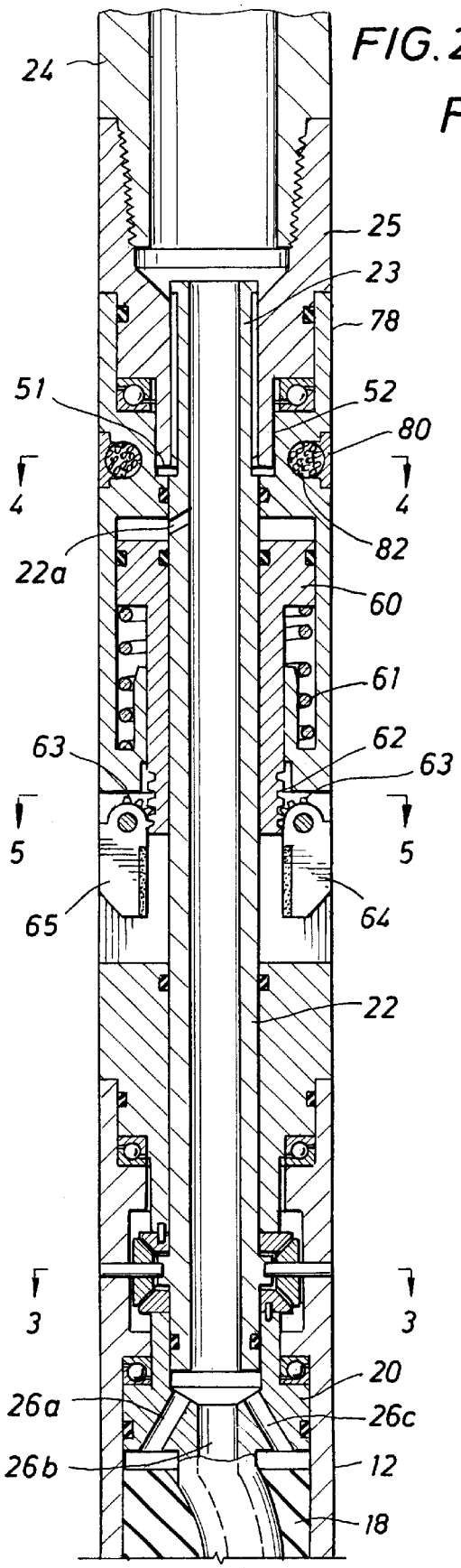
FIG. 2A and 2B are sectional views of the portion of the drilling assembly of this invention from the drill bit to the drill pipe connected to the upper end of the drilling assembly.
Figure 2B:
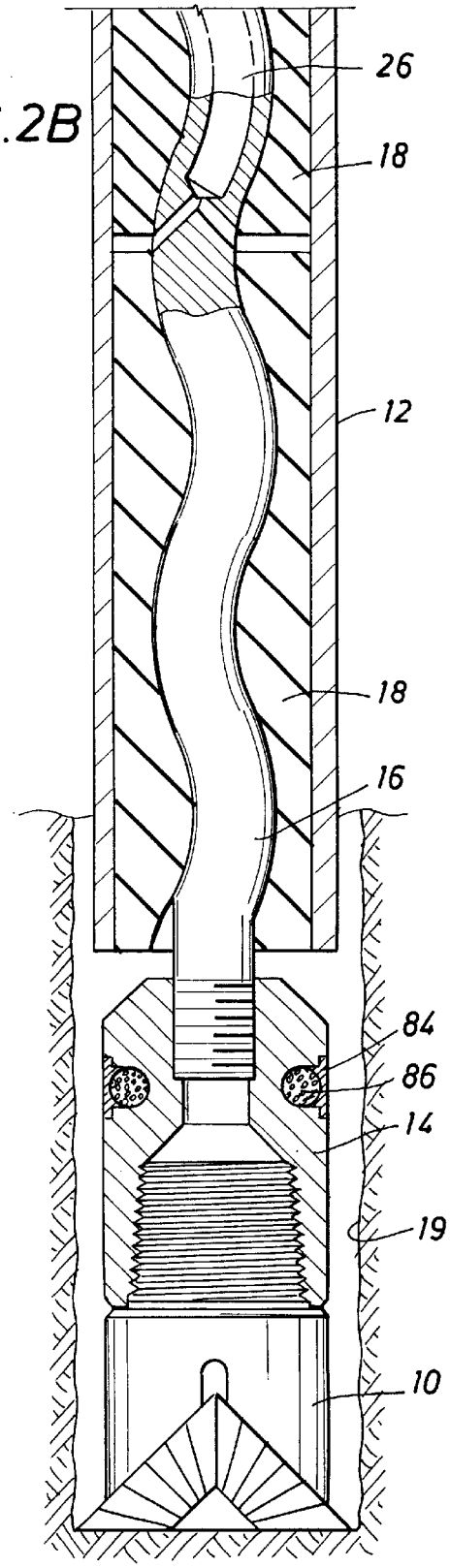

Specifically, FIGS. 2A and 2B are sectional views of the apparatus of this invention for rotating the drill bit. Drill bit 10, that is in engagement with the bottom of the well bore, is connected by sub 14 to the end of output shaft 16 of pump 12, which is preferably a Robbins & Myers Moynog®-brand pump, and referred to hereinafter as "Moyno pump". In FIG. 2A, the upper end of Moyno pump 12 is shown connected to flow diverter 20. Above flow diverter 20, mandrel 22 extends from tool joint box 25 to just above flow diverter 20 and ties all the various parts of this tool together. It is a hollow tube and the upper end is positioned in line with the opening in drill pipe pin 24 as shown in FIG. 2A. Fluid pumped down the drill pipe will flow through hollow central mandrel 22 and ports 26*a*, 26*b* and 26*c* in flow diverter 20 positioned at the bottom of the tube. Flow diverter 20 is an integral part of shaft 16 of Moyno pump 12. Central passage 26*b* is located in the impeller of Moyno pump 12 and fluid flows through opening 26*b* to the top of resilient body 18 of Moyno pump 12. This fluid then provides the power to rotate shaft 16 of the Moyno pump and bit 10 that is attached to the lower end of output shaft 16 of the Moyno pump to drill well bore 19.

Figure 3:
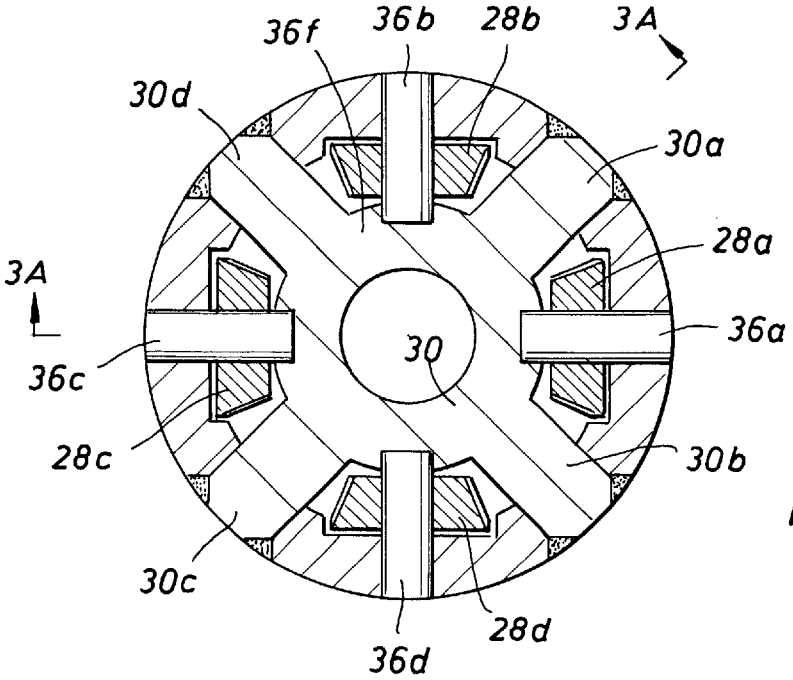
FIG. 3 is a sectional view taken along line 3—3 of FIG. 2A.
Figure 3A:
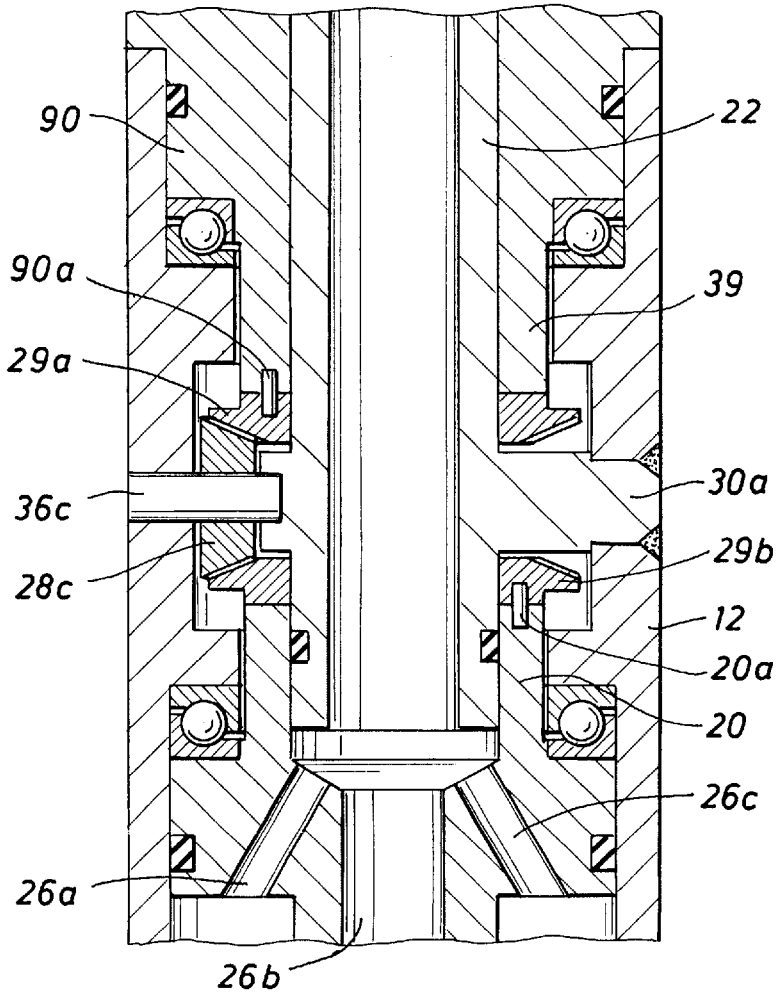
FIG. 3A is a detail elevation section view of the gear box portion of the drilling assembly taken along line 3A—3A of FIG. 3.
Figure 6:
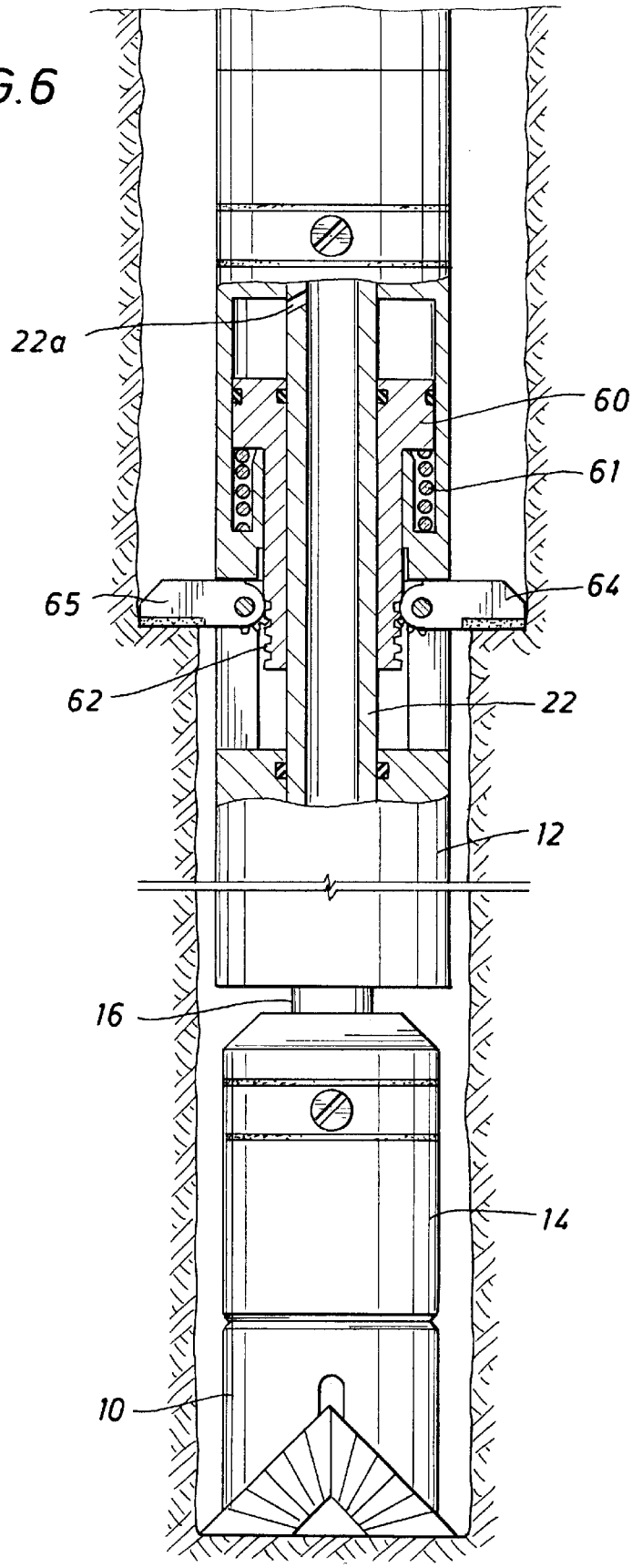
FIG. 6 is a view, similar to FIG. 1 showing in section the components of the underreamer that move the cutting arms of the underreamer into position to enlarge the diameter of well bore 19 as the well bore is being drilled.

Referring now to FIG. 3 and FIG. 3A, which are enlarged sectional views of the gear box that is located above the Moyno pump and is connected to mandrel 22. As shown in FIG. 3 there are four equally spaced pinions, 28*a,* 28*b,* 28*c* and 28d in the gear train which engage two longitudinally spaced, annular bevel ring gears 29*a* and 29*b,* the beveled ring gear teeth of which diverge outwardly. The upper ring gear 29*a* is pinned to an upper spacer 90 with a pin 90*a* and the lower ring gear 29*b* is pinned to lower spacer 20. The pins connecting the upper and lower ring gears to the spacers hold the ring gears from rotation relative to the spacers and the housing. Pinion 28*a* is not shown in FIG. 3A in order to show the structural arrangement of arms 30*a*–30*d* of anchor spider 30 on which the pinions are mounted. The spider consists of a central tubular section 36*f* with four arms 30*a,* 30*b,* 30*c,* and 30*d* symmetrically extending radially from the center section. The central section is designated by number 30*f* and the arms are 39*a* through 30*d.* The arms are welded to tubular housing 39 in which they are located, as shown in FIG. 3 and also FIG. 3A. Pins 36*a* through 36*d* are mounted in the wall of the housing and support pinions 28*a* through 28*d* for rotation as shown in FIG. 3.

FIG. 3A is the vertical section through FIG. 3 taken along line 3A—3A in FIG. 3. Consequently, the pinion on pin 36*a* is not shown. As explained above, drilling fluid will be pumped down through the center of mandrel 22 and when the fluid reaches the lower end of tube 22 the fluid will exit through large port 26*b* and provide drilling fluid under pressure to the Moyno pump 12 to rotate bit 10 that is connected to the lower end of the apparatus. Portions of the fluid in mandrel 22 will be diverted through smaller outlets 26*a* and 26*c.* As explained above this fluid will flow through opening 26*b* into the Moyno pump to provide the force necessary to rotate motor shaft 16 of the Moyno pump and bit 10.

Torque tube or mandrel 22 has opening 22*a* as shown in FIGS 2A and C through which drilling fluid being pumped down the drill pipe into the motor will flow and exert a downward force on piston 60 causing the piston to move downwardly against spring 61 so that rachet teeth 62 that engage rachet teeth 63 on cutting arms 64 and 65, will rotate the cutting arms outwardly to a lateral position relative to the longitudinal axis of the tool rotation of the tool will cause cutting arm 64 and 65 to enlarge the diameter of the hole being drilled by bit 10 as the underreamer is rotated and lowered as shown in FIG. 1.

A significant factor in premature mud motor failures is caused by imbalance and harmonic vibrations, due to the fact that the bit, the stabilizers, and the underreamers get unbalanced due to cuttings getting packed into stabilizer ribs (leading edges) and drilling bit legs. This extra weight is eccentric to the center line of the drilling assembly and that creates an imbalance and vibrations that creates a side thrust load on the mud motor bearings.

Figure 4:
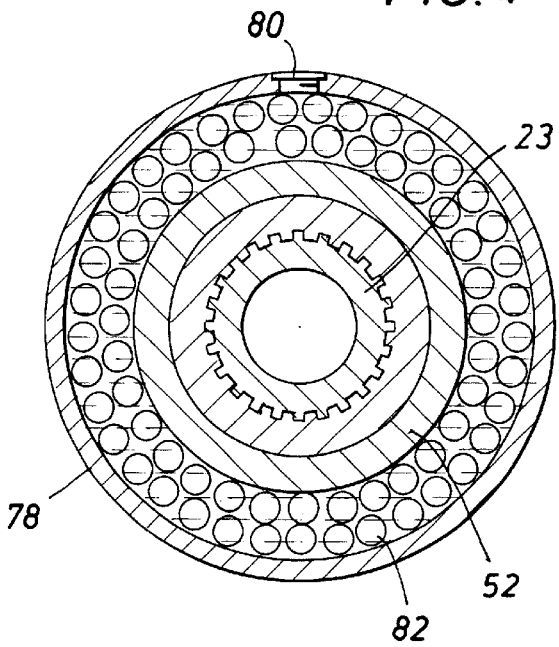
FIG. 4 is a sectional view taken along line 4—4 of FIG. 2A of balancing ring 80. The balancing ring comprises annular groove 82 with a semicircular bottom. The groove is filled with balls of high density metal, such as lead, tungsten carbide or depleted uranium. Preferably, the balls do not completely fill the groove so they can move to a position in the groove in response to the centrifugal force on the balls produced by the rotation of the tool and to provide a balancing force to the rotating members.
Figure 5:
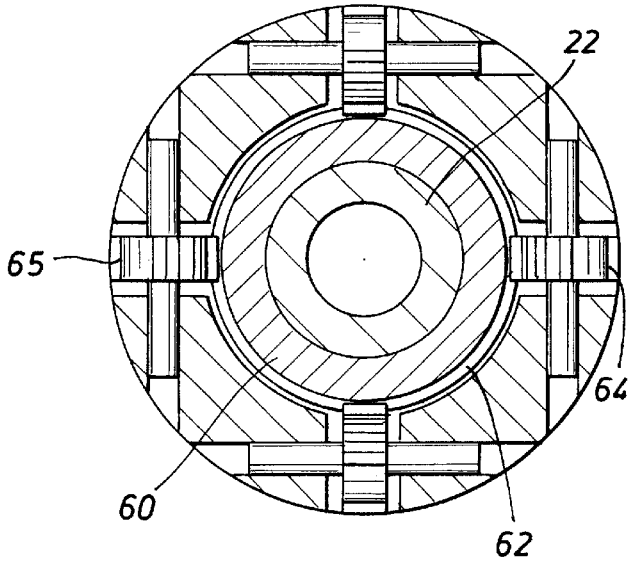
FIG. 5 is a sectional view taken along line 5—5 of FIG. 2A.

Circumferential balancing grooves, such as 82 and 86, on rotating members are filled with a high density median, such as tungsten or depleted uranium in light oil and TEFLON liquid carrier will tend to selfbalance by rotating centrifugal force. The high density median would compensate for the imbalance caused by the extra mass of impacted/compacted formation. These rings could be machined on rotating members (stabilizers, underreamers, bit subs etc.) and filled with the high-density balancing fluid. FIG. 4 is a cross sectional view taken along line 4—4 of FIG. 2A of balancing ring 82. Mandrel 22 is in the center surrounded by a portion of body 82 and the upper end of torque tube 22 and spline connection 23.

What is claimed is:

1. In a downhole drilling assembly including a drill bit on a drill string for drilling a well bore and an underreamer positioned above the bit for increasing the diameter of the hole drilled by the bit, the improvement comprising means connected in the drill string between the bit and the underreamer to rotate the drill bit in a direction opposite to the direction of rotation of the underreamer to substantially balance the reactive torque transmitted from the bit and the underreamer to the drill string.

2. The drilling assembly of claim 1 in which the means connected in the drill string between the bit and the underreamer comprises two longitudinally spaced, annular bevel ring gears having teeth, the bevel ring gear teeth of which diverge outwardly, an upper spacer positioned in a housing between the underreamer and the ring gears, a lower spacer positioned in the housing below the ring gears, pins connecting the upper and lower ring gears to the spacers to hold the ring gears from rotation relative to the spacers and the housing, a set of four beveled pinion gears equally spaced circumferentially between the bevel ring gears with teeth of the pinion gears meshing with the teeth of the bevel ring gears so that rotation of the upper bevel ring gear with the underreamer along with drilling fluid being pumped downwardly through the underreamer will rotate the lower bevel ring gear, a hydraulic motor between the lower bevel ring gear and the drill bit attached to the lower end of an output shaft of the motor to cause the bit to rotate in a direction opposite that of the underreamer, to bore a hole of a diameter less than that created by the underreamer, and to balance the reactive torque of the underreamer.

3. The drilling assembly of claim 1 further comprising a body between the drill string and the underreamer, the body provided with annular grooves in the outer surface of the body partially filled with a mixture of solids having a high specific gravity and a low viscosity liquid that combines with the solids to provide a stabilizing force that tend to compensate for the imbalance caused by different amounts of solids adhering to one side or the other of the drilling assembly.

4. The drilling assembly of claim 3 in which the solids are formed of tungsten.

5. The drilling assembly of claim 3 in which the solids are formed of depleted uranium.

6. In an apparatus for drilling a well bore comprising a downhole assembly including a string of drill pipe, a drill bit for drilling a well bore having a preselected diameter connected to the lower end of the drill string, an underreamer connected in the drill string above the drill bit for enlarging the hole drilled by the drill bit, the improvement comprising a gear box in the drill string between the drill bit and the underreamer for rotating the section of the drill pipe and the drill bit below the gear box in a direction opposite the direction of rotation of the drill pipe above the gear box to substantially balance the torque imposed on the drill pipe above the bit to substantially eliminate the tendency of the bit to walk either to the right or left.

7. A method of simultaneously drilling a well bore of a given diameter and simultaneously increasing the diameter of the previously drilled well bore comprising the steps of rotating a drill bit in one direction to drill a well bore of one diameter and simultaneously underreaming the previously drilled well bore by rotating an underreamer in the opposite direction.

8. The method of claim 7 in which one of the drill bit and the underreamer is rotated by a mud motor in one direction and the other of the drill bit and underreamer is rotated in the opposite direction by a gear train.

9. A rotating balanced torque drilling assembly for connecting in a string of drill pipe above a drill bit for drilling a well bore and simultaneously reaming the drilled well bore to a larger diameter with substantially no torque imposed on the drill string, said assembly comprising a. a sub connected to the drill string;

b. a hollow mandrel extending from the sub;

c. a piston below the sub through which the mandrel extends, d. an underreamer comprising reaming arms mounted on the piston for rotation between a non-reaming position, generally parallel to the axis of rotation of the assembly and a laterally extending position for reaming the wall of the well bore to increase the diameter of the well bore as the reaming arms are rotated and lowered in the well bore;

e. an opening in the mandrel positioned to supply drilling fluid under pressure to move the piston longitudinally of the axis of rotation of the assembly to rotate the reaming arms outwardly into a position to enlarge the diameter of the well bore as the tool is rotated;

f. resilient means positioned to resist the movement of the piston to actuate the reaming arms and to return the reaming arms to a position within the body when the fluid pressure is relieved;

g. a lower housing extending below the underreamer;

h. a spacer mounted for rotation around the mandrel; and i. a gear box mounted on the mandrel below the spacer, said gear box having spaced bevel gears and pinion gears between the bevel gears, said pinion gears being supported for rotation by shafts extending through the wall of the housing and the center of each pinion to support the pinions for rotation around the shafts as the bevel gears rotate.

* * * * *